US005842566A

United States Patent [19]

White

[11] Patent Number: 5,842,566

[45] Date of Patent: Dec. 1, 1998

[54] MERCHANDIZING DISPLAY CARTON FOR HANDLED GOODS

[75] Inventor: Timothy L. White, Wadsworth, Ohio

[73] Assignee: Rubbermaid Incorporated, Wooster, Ohio

[21] Appl. No.: 890,632

[22] Filed: Jul. 9, 1997

[51] Int. Cl.[6] ..... B65D 85/20

[52] U.S. Cl. ..... 206/362; 206/362.4; 211/65

[58] Field of Search ..... 206/361, 362, 206/362.1, 362.4, 15.2, 15.3, 485, 523, 756; 229/199

[56] References Cited

U.S. PATENT DOCUMENTS

| | | | |
|---|---|---|---|
| 540,268 | 6/1895 | Newell . | |
| 1,841,753 | 1/1932 | Merkle . | |
| 2,723,026 | 11/1955 | Paige . | |
| 2,956,687 | 10/1960 | Robichaud . | |
| 3,262,556 | 7/1966 | Morrison . | |
| 3,291,295 | 12/1966 | Caligiuri . | |
| 3,603,551 | 9/1971 | Peterson | 211/65 |
| 3,819,034 | 6/1974 | Clark . | |
| 3,819,042 | 6/1974 | Smernoff . | |
| 4,426,015 | 1/1984 | Preston et al. | 229/199 |
| 4,533,044 | 8/1985 | Ban . | |
| 4,573,569 | 3/1986 | Parker . | |
| 4,962,989 | 10/1990 | Jung et al. | 206/485 |
| 5,005,710 | 4/1991 | Hofer | 211/70.6 |
| 5,092,463 | 3/1992 | Dees . | |
| 5,330,056 | 7/1994 | De La Rocha | 206/362 |
| 5,363,870 | 11/1994 | Doyon . | |
| 5,373,939 | 12/1994 | Bloomgren . | |
| 5,415,343 | 5/1995 | Vosbikian | 229/199 |
| 5,540,363 | 7/1996 | Wilson . | |
| 5,573,115 | 11/1996 | Fuller . | |

*Primary Examiner*—Paul T. Sewell
*Assistant Examiner*—Luan K. Bui
*Attorney, Agent, or Firm*—Renner, Kenner, Greive, Bobak, Taylor & Weber

[57] ABSTRACT

A display carton (10) for holding items (11, 12) having handles (13) includes side walls (14) extending upwardly from a bottom surface (15) to form an open top defined by a rim surface (16). The carton (10) has an upper panel (20) having slots (31) formed therein and a lower panel (27) also having slots (37) formed therein. At least the upper panel (20) is provided with strips (34, 35) of foam material positioned below and extending into the opening of the slots (31). As the handles (13) are positioned in the slots (31), the strips (34, 35) grip the handles (13) to securely hold them in the carton (10).

16 Claims, 3 Drawing Sheets

MERCHANDIZING DISPLAY CARTON FOR HANDLED GOODS

TECHNICAL FIELD

This invention relates to a carton for use in holding items for retail display. More particularly, this invention relates to merchandizing display cartons which are particularly suited to hold stick handled items such as brooms, mops or the like, in an upright and spaced position.

BACKGROUND ART

The attractive safe and convenient retail display of long handled goods such as brooms, mops and the like has always been a problem for the merchandiser. Usually the retailer will display such items in a box having an open top with the handles extending into the box and the head portion of the product extending upwardly out of the top of the box for the viewing thereof by the customer. In most such displays, the items are randomly positioned and leaning in the box which not only is visually unattractive, but also can result in the display becoming top heavy such that the box may topple over.

Some attempts have been made at solving the aforementioned problems. For example, in some types of displays, an upper horizontal panel is positioned to close the open top of the display box. Apertures conforming to the size of the stick handled items are provided in the panel to hold the items in an inverted upright position. While such does serve to maintain the items in an orderly condition, it is not without problems of its own. First, such display boxes are limited in the number and type of articles to be displayed, as dictated by the size and the number of the apertures. Thus, such cannot universally accommodate products having different sized handles. Moreover, in order to obtain the necessary tight fit between the apertures and the handles, it is possible that the handles could become scuffed or scarred upon insertion and removal from the display. Such is particularly possible when synthetic, as opposed to wooden, handles are provided for the item, as is the case in many modern day soft handled products.

In another known display, two closely vertically spaced panels are employed to close the open top of the box and to hold the items. To that end, each panel is provided with a plurality of serrated or sawtooth slots therein. Usually something as unsophisticated as a system of rubber bands biases one panel relative to the other to create a holding force on the handles of items positioned through the slots. While such a system may be able to accommodate items having varying sized handles, it is more costly and suffers from problems such as a breakage of the biasing system. Moreover, the rubber band system does not provide a uniform holding force along the slot. Thus, items held at the ends of the slots are often too firmly gripped while others near the center of the slots may not be adequately gripped. Of course, any over gripping of any handled item could accentuate the scuffing problems previously discussed.

Thus, the need exists for a retail display box for long handled items which can be economically produced to carry a large number of varying sized items without any probability of damage to the item.

DISCLOSURE OF THE INVENTION

It is thus an object of the present invention to provide a display carton for long handled items.

It is another object of the present invention to provide a display carton, as above, which holds the items in an upright, inverted position.

It is a further object of the present invention to provide a display carton, as above, which can hold items having varying sized handles.

It is an additional object of the present invention to provide a display carton, as above, which is not limited to a precise volume of items to be held.

It is yet another object of the present invention to provide a display carton, as above, in which the items are held with a uniform force.

It is still another object of the present invention to provide a display carton, as above, which will not damage the handles of the items being held.

It is a still further object of the present invention to provide a display carton, as above, which can also be utilized to ship the items carried thereby.

It is an additional object of the present invention to provide a display carton, as above, which is inexpensive to manufacture and which requires no maintenance.

These and other objects of the present invention, as well as the advantages thereof over existing prior art forms, which will become apparent from the description to follow, are accomplished by the improvements hereinafter described and claimed.

In general, a carton for holding items having a handle includes side walls forming a container having an open top. A panel is carried between the side walls and has at least one slot formed therein to receive a handle therethrough. A resilient material is carried by the panel so as to interfere with the movement of the handle through the slot and thereby hold the item in the carton.

A preferred exemplary display carton incorporating the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
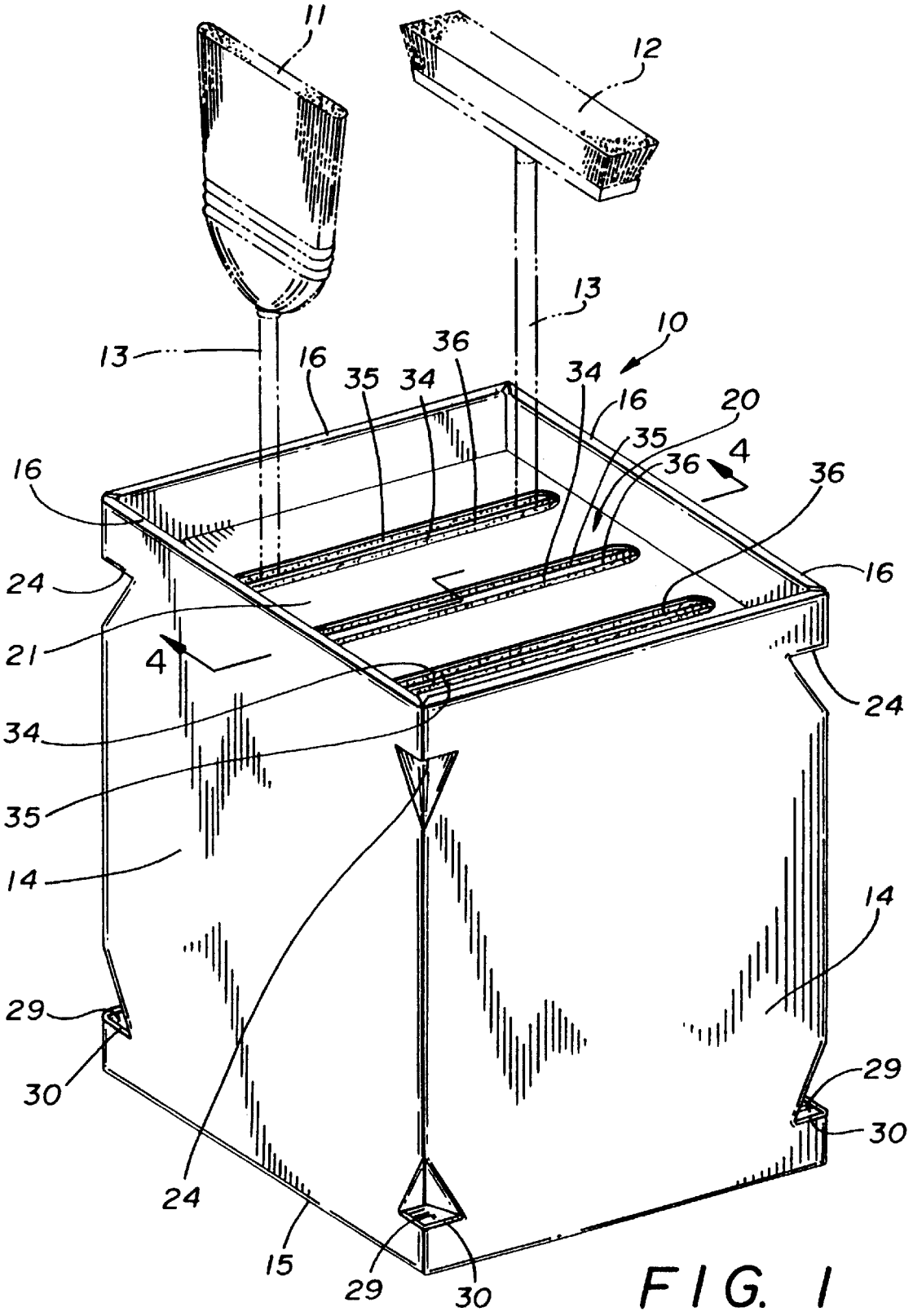
FIG. 1 is perspective view of a display carton made in accordance with the concepts of the present invention showing an upper panel holding long handled items.

A display carton made in accordance with the concepts of the present invention is indicated generally by the numeral 10 in FIG. 1. Carton 10 is preferably constructed of a relatively sturdy cardboard-like material and is intended to be used by a merchandiser to display items such as a broom 11, brush 12 or other items having long stick-like handles 13, such as mops or the like. The items to be displayed may also conveniently be shipped to the merchandiser in carton 10 and as such, the items will be available to the merchandiser for immediate display without the need for any on site assembly.

Figure 2:
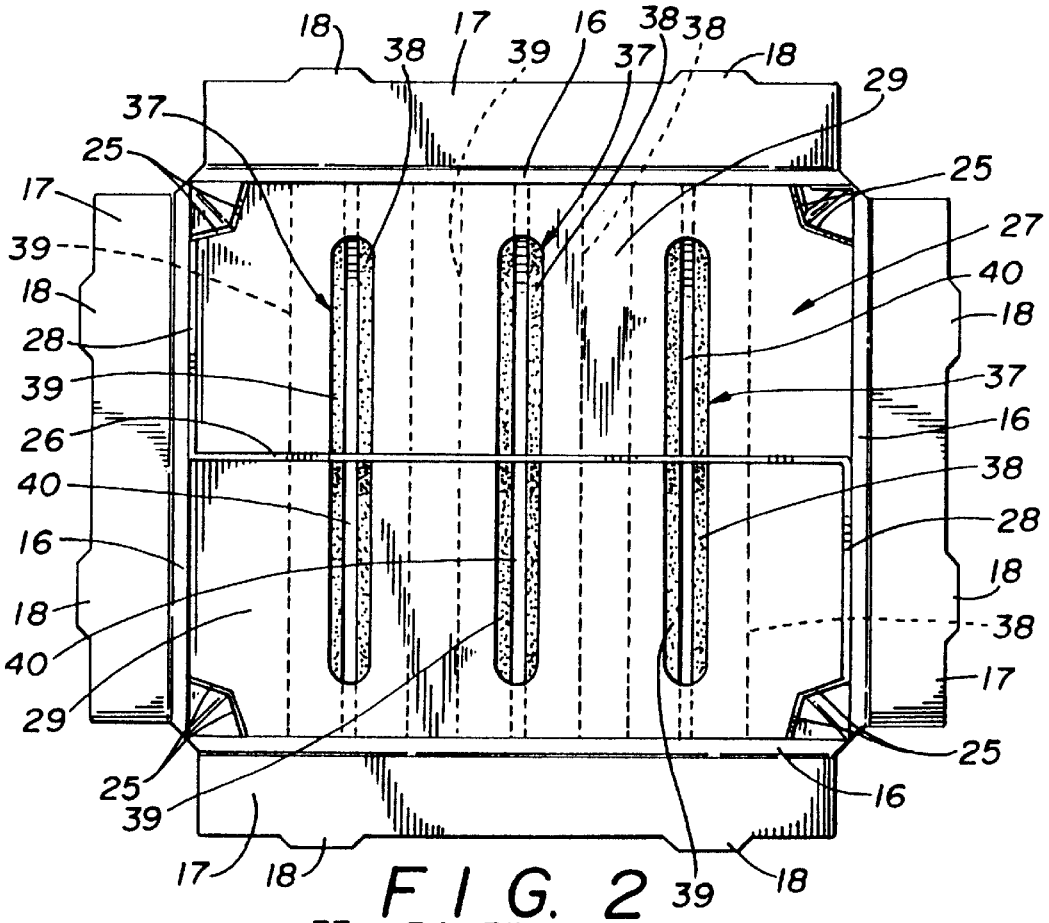
FIG. 2 is a top plan view of the display carton of FIG. 1 shown with the upper panel removed and the top open.

Carton 10 includes four side walls 14 extending upwardly from a bottom surface 15 thereby forming a container having an open top defined by a peripheral rim surface 16. As shown in FIG. 2, prior to its assembled condition, the upper ends of side walls 14 are shown as having flaps 17 foldably carried by surface 16. Each flap 17 is shown as having two lock tabs 18 formed on the outer ends thereof.

Figure 3:
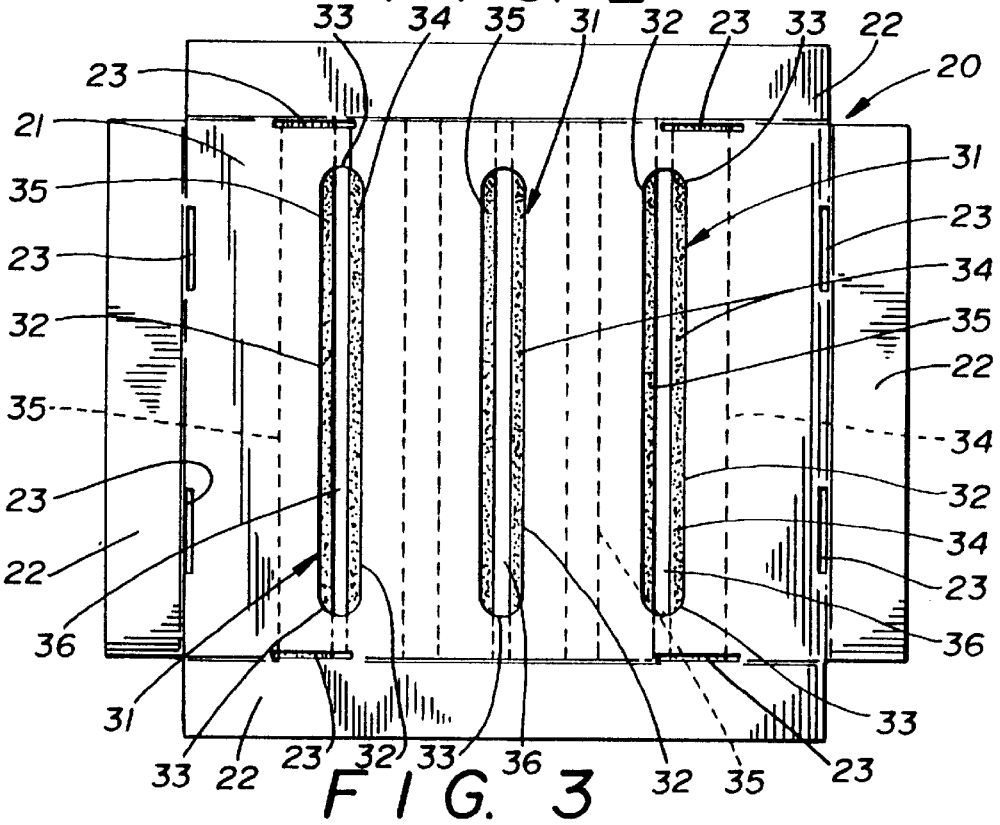
FIG. 3 is a top plan view of the upper panel of the display carton of FIG. 1 shown in a condition prior to assembly in the display carton.

Carton 10 also includes a panel, generally indicated by the numeral 20, horizontally positioned near the open top thereof. As best shown in FIG. 3, panel 20 includes a flat surface 21 having outer dimensions generally conforming to the inner dimensions of carton 10 as defined by side walls 14. A flap 22 is foldably carried at each peripheral edge of surface 21 and a plurality of slots 23 are formed through panel 20 at the approximate junction of flaps 22 and surface 21. While surface 21 and flaps 22 of panel 20 may be fabricated from a single sheet of material, as shown in FIG. 4, panel 20 is preferably formed of two plies of material to provide additional strength.

Figure 4:
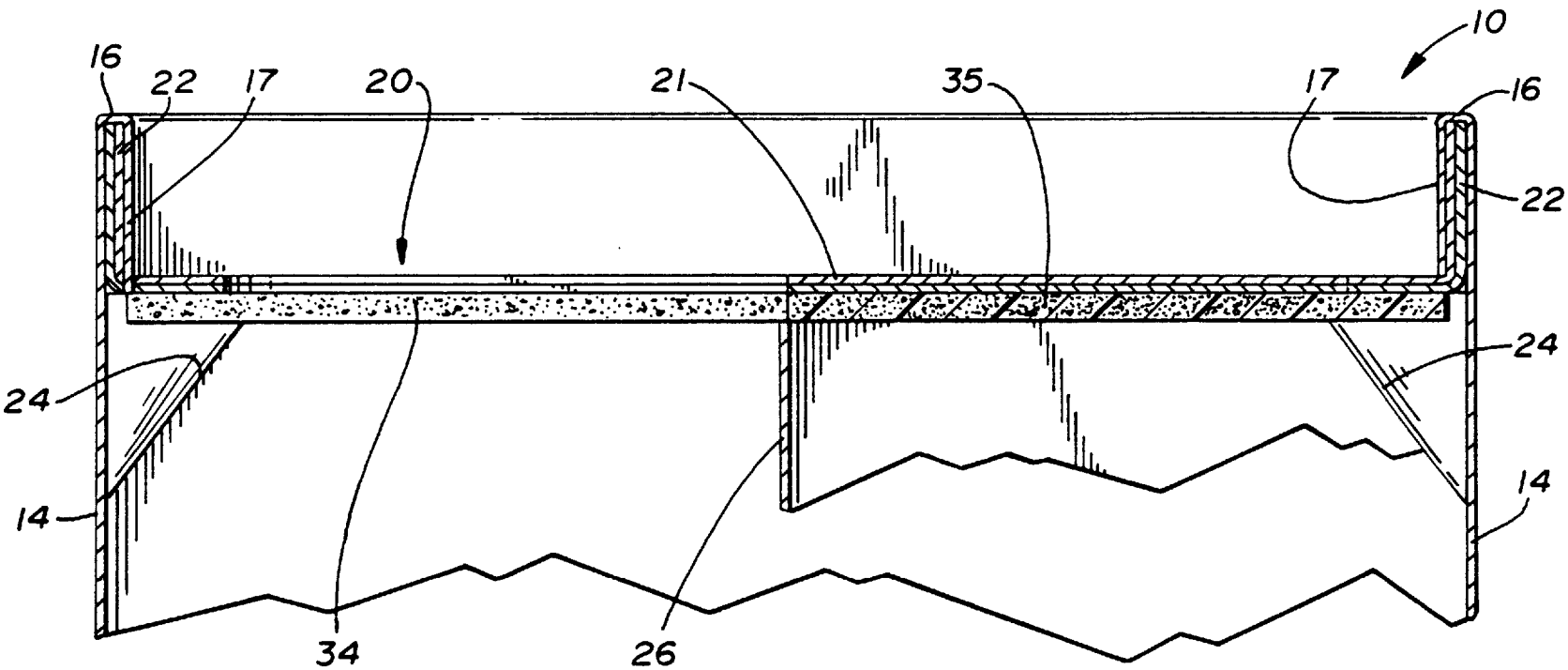
FIG. 4 is a fragmented sectional view taken substantially along line 4—4 of FIG. 1.

As best shown in FIG. 4, panel 20 is assembled into carton 10 by having the flaps 22 thereof sandwiched between side walls 14 and flaps 17. To that end, with the panel flaps 22 vertically positioned, flaps 17 are folded inwardly over flaps 22 and tabs 18 are inserted into slots 23 to hold panel 20 in place. A generally horizontal cut 24 may be made in each corner of carton 10 and the material below the cut may be pushed inwardly to provide support ledges 25 for panel 20 underneath the four corners thereof as shown in FIG. 2. Central support for panel 20 can also be provided by a rib 26 extending from one wall 14 across to its opposed wall 14 and extending downwardly into carton 10 to rest either on the bottom surface 15 thereof or on a lower panel generally indicated by the numeral 27 which is preferably provided in carton 10 as will be hereinafter described. Rib 26 can be formed of a straight piece of cardboard material, but for ease of assembly and proper positioning thereof in the center of carton 10, rib 26 is shown as being part of a Z-shaped sheet of material having wings 28 extending from the ends of rib 26 and along side walls 14 toward the corners of carton 10.

Lower panel 27 can be essentially identical to panel 20 and thus it includes a flat surface 29. Its flaps (not shown) equivalent to flaps 22 of panel 20, can be folded vertically downwardly to vertically locate flat surface 29 somewhat spaced from carton bottom surface 15. A generally horizontal cut 30 may be made in each corner of carton 10 and the material above the cut may be pushed inwardly so that ledges, which are like ledges 25, rest on the top of the four corners of surface 29.

Surface 21 of panel 20 is provided with a plurality (three shown) of slots therein, generally indicated by the numeral 31. Slots 31 are preferably parallel to each other and extend longitudinally from near one carton end wall 14 across to near the opposed carton end wall 14. Each slot 31 is defined by longitudinally extending lateral edges 32 joined at their ends by arcuate edges 33. Opposed strips of a resilient material, such as foam strips 34 and 35 are shown as being attached to the underside of surface 21, as by a hot melt adhesive. Strips 34 and 35 are parallel to each other and, as shown by the dotted lines in FIG. 3, can extend longitudinally from one end of surface 21 to its opposed end. As shown, at least a portion of strips 34 and 35 extend into and below the open area of slots 31 and are spaced from each other, as at space 36. The space 36 between the inner edge of strips 34 and 35 is preferably a distance of slightly less than the size of the smallest handle 13 of an item expected to be displayed in carton 10, and as such interferes with the placement of a handle 13 therethrough. Thus, when an item such as broom 11 or brush 12 is placed in carton 10 as shown in FIG. 1, its handle 13 is positioned in a slot 31 and is tightly held by strips 34 and 35. Larger handles can be accommodated because as they are pushed downwardly into carton 10, the foam strips 34 and 35 compress. During such downward movement, panel 20 is supported from below both by the ledges 25 at the corners and by rib 26 extending across panel 20. The items can be easily pulled out of slots 31 as the foam strips 34 and 35 will readily release the handles 13. Such upward movement does not deform panel 20 as its flaps 22 are securely held under rim 16. Because of the resilient or soft nature of strips 34 and 35, handles 13 will not be scuffed or damaged.

Surface 29 of lower panel 27 is also shown as having slots 37 therein which can be identical to slots 31. As such, the bottom of handles 13 extend through and can be supported by slots 37. Slots 37 can be optionally provided with opposed foam strips 38 and 39 which are identically mounted and positioned on surface 29 of panel 27 as are strips 34 and 35 on surface 21. As such, a space 40 is formed between the edges of foam strips 38 and 39 which, like space 36, grips handles 13 near the bottom thereof. As the handles 13 are pulled out of the grip afforded by foam strips 38 and 39, lower panel 27 is maintained in its position by the ledge formed by cut 30 and positioned above each corner of surface 29.

It should thus be evident that a display carton constructed as described above is capable of firmly holding handled items of various sizes in an upright position without damaging the handles of the items, and otherwise accomplishes the objects of the present invention thereby substantially improving the art.

I claim:

1. A carton for holding items having a handle comprising side walls forming a container having an open top, a panel carried between said side walls, support ledges formed at each intersection of said side walls and positioned under the corners of said panel, at least one slot formed in said panel to receive a handle therethrough, and a resilient material carried by said panel so as to interfere with the movement of a handle through said slot and thereby hold the item in the carton.

2. A carton according to claim 1 wherein said resilient material is attached to the underside of said panel.

3. A carton according to claim 2 wherein said resilient material includes foam strips having spaced edges extending below said slot.

4. A carton according to claim 1 further comprising means to support is said panel positioned generally centrally of and underneath said panel.

5. A carton according to claim 1 further comprising means to attach said panel to said side walls.

6. A carton according to claim 1 wherein said panel is carried by said side walls adjacent to the open top.

7. A carton according to claim 6, there being a plurality of longitudinally extending parallel slots formed in said panel.

8. A carton according to claim 7 wherein said resilient material is provided for each of said slots.

9. A carton according to claim 8 further comprising a second panel carried by said side walls adjacent to the bottom thereof, and a plurality of longitudinally extending parallel slots formed in said second panel and aligned with said slots formed in said panel.

10. A carton according to claim 9 further comprising a resilient material carried by said second panel so as to interfere with the movement of a handle through said slots of said second panel.

11. A carton according to claim 9 further comprising means formed at each intersection of said side walls to support the bottom of said panel.

12. A carton according to claim 11 further comprising means formed at each intersection of said side walls to hold down said second panel.

13. A carton for holding items having a handle comprising side walls forming a container having an open top, a first panel carried between said side walls, at least one slot formed in said first panel to receive a handle therethrough, a second panel vertically spaced from said first panel and having at least one slot formed therein and aligned with said slot of said first panel to receive a handle therethrough, a resilient material carried by said first panel so as to interfere with the movement of a handle through said slot and thereby hold the item in the carton, and a resilient material carried by said second panel so as to interfere with the movement of a handle through said slot of said second panel.

14. A carton according to claim 13 further comprising means to hold down said second panel.

15. A carton according to claim 14 wherein said means to hold down includes ledges formed at each intersection of said side walls and positioned over the corners of said second panel.

16. A carton for holding items having a handle comprising side walls forming a container having an open top, a panel carried between said side walls, at least one slot in said panel forming a handle receiving area, a first strip of resilient material carried along one side of said slot and extending into said handle receiving area, and a second strip of resilient material carried along the other side of said slot and extending into said handle receiving area, said first and second strips of resilient material having spaced edges extending below said slot.

* * * * *